United States Patent [19]

Fusy

[11] 4,418,718

[45] Dec. 6, 1983

[54] METHOD AND APPARATUS FOR CONTROLLING ARTICULATED FLUID LOADING ARMS UPON EMERGENCY DISCONNECTION

[75] Inventor: Joel L. Fusy, Sens, France

[73] Assignee: FMC Corporation, Chicago, Ill.

[21] Appl. No.: 283,584

[22] Filed: Jul. 15, 1981

[30] Foreign Application Priority Data

Jul. 28, 1980 [FR] France ..... 80 16565

[51] Int. Cl.[3] ..... B65B 3/04

[52] U.S. Cl. ..... 137/615; 141/387

[58] Field of Search ..... 137/615; 141/387

[56] References Cited

U.S. PATENT DOCUMENTS

| | | | |
|---|---|---|---|
| 3,340,907 | 9/1967 | Bily | 137/615 |
| 3,455,333 | 7/1969 | Bily | 137/615 |
| 3,581,769 | 6/1971 | Haley | 137/615 |

*Primary Examiner*—A. Michael Chambers

*Attorney, Agent, or Firm*—W. William Ritt, Jr.; Richard B. Megley

[57] ABSTRACT

An articulated marine fluid loading arm comprising rigid, pivotally-interconnected inner and outer arm members with the inner arm member pivotally mounted on an upstanding riser for movement about horizontal and vertical axes, and a system for controlling the arm during emergency disconnection thereof from a tanker or other marine vessel. The system includes an auxiliary counterweight pivotally mounted on a support beam that is fixed to, and extends rearwardly from, the riser end of the inner arm member, a pantograph-type sheave and cable assembly interconnecting the counterweight and the riser, and hydraulic cylinders to control the operation of the sheave and cable assembly so that the moment exerted by the counterweight can be imposed either on the inboard arm member or the riser.

7 Claims, 10 Drawing Figures

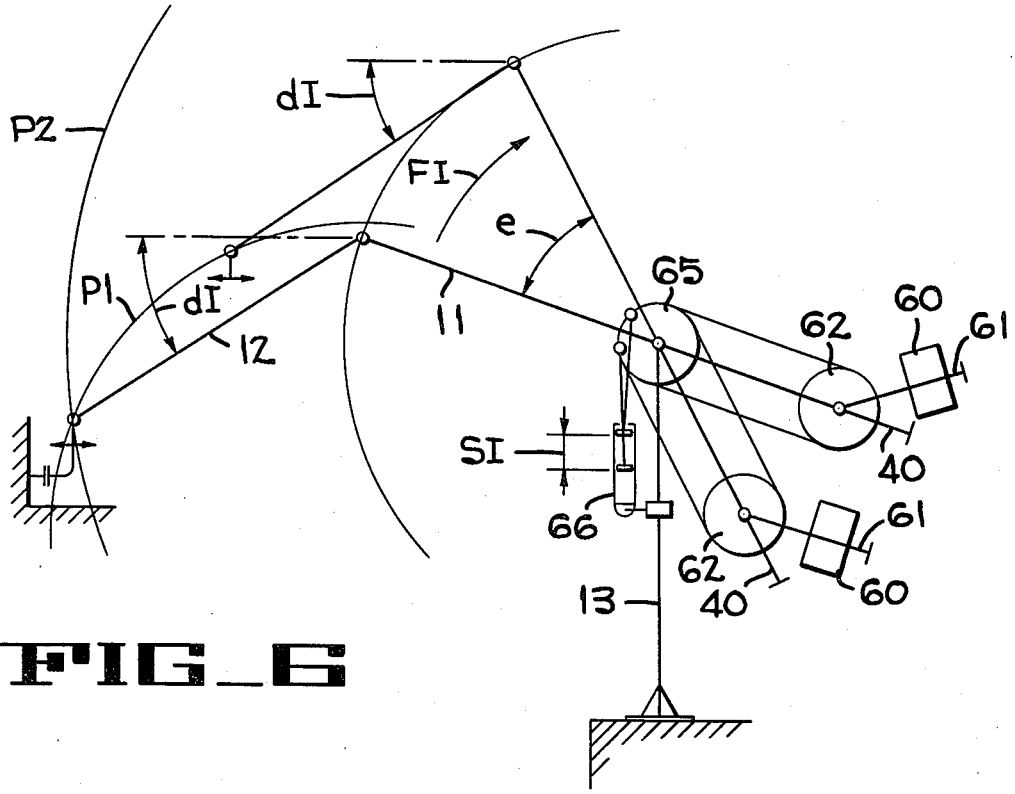
FIG_6
FIG_7
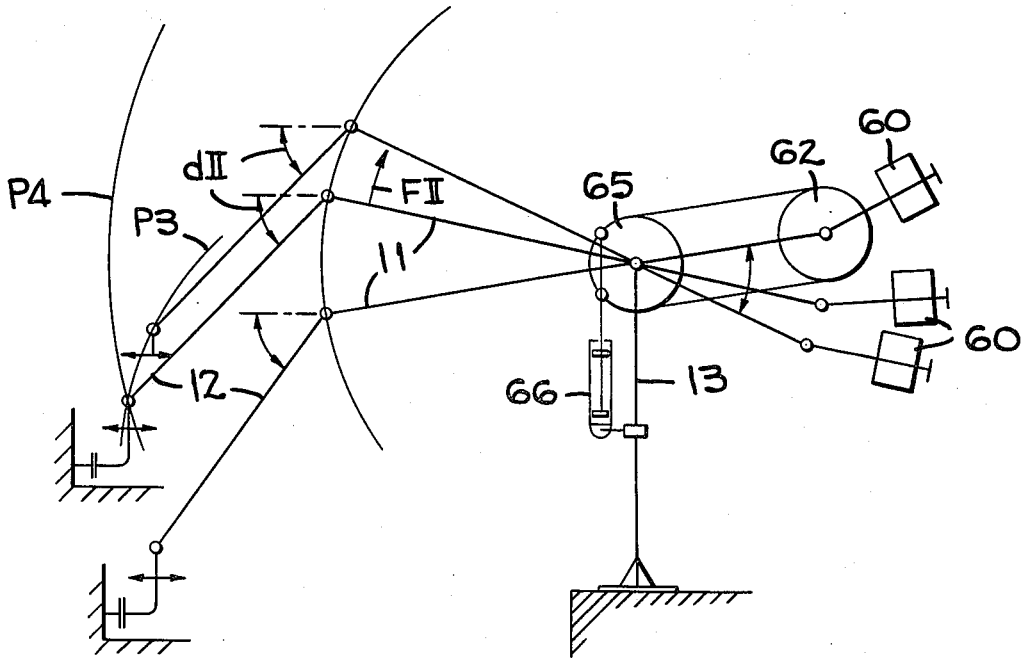

FIG_8
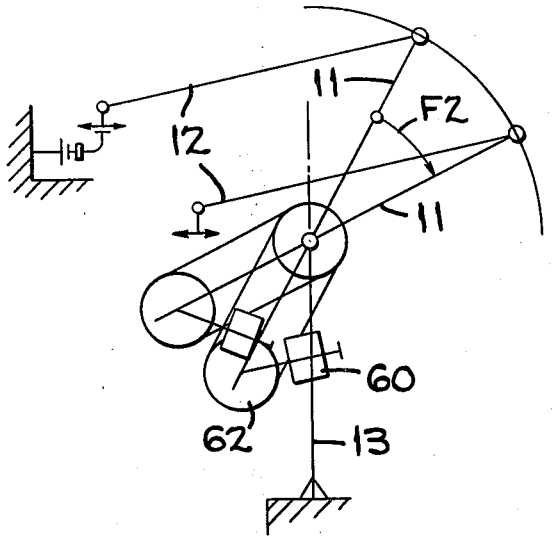
FIG_9
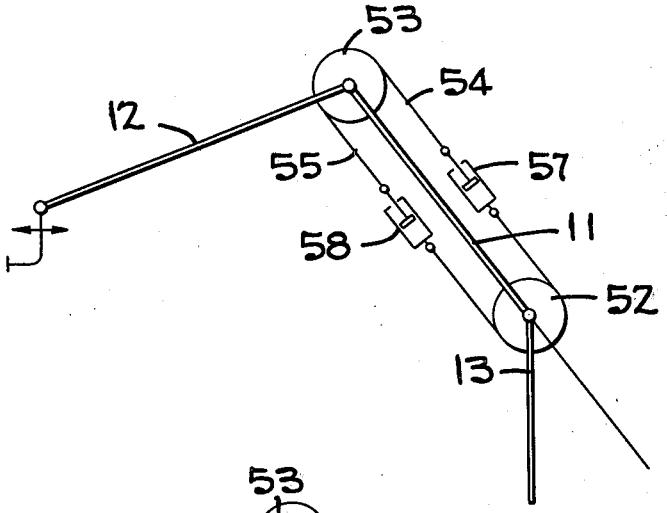
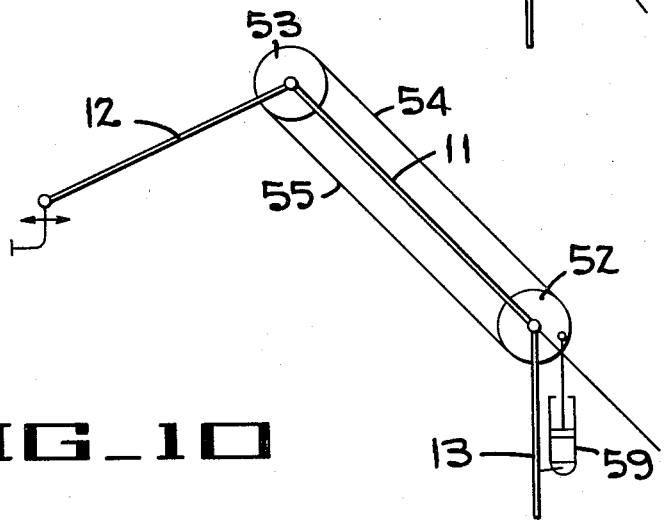
FIG_10

METHOD AND APPARATUS FOR CONTROLLING ARTICULATED FLUID LOADING ARMS UPON EMERGENCY DISCONNECTION

BACKGROUND OF THE INVENTION

1. Field of the Invention

The present invention relates to fluid handling apparatus, and more particularly to marine tanker loading arms with systems for counterbalancing the arm members.

2. Description of the Prior Art

Various types of fluid transferring devices are used in conveying fluids between a dock, buoy, or floating barge and a tanker or other marine transport vessel. Some of these devices are large articulated pipe structures referred to as marine loading arms, such an arm generally comprising an upstanding support riser on which is pivotally mounted an assembly of two or more arm members that are pivotally interconnected by swivel joints in a manner to allow the arm to accommodate itself to the movements of the buoy, barge and/or tanker while fluid transfer is in progress. Some examples of these prior art fluid transferring devices are described in U.S. Pat. Nos. 2,980,150 and 3,382,892 to Bily, 3,581,769 to Haley, and 3,889,728 to Riche.

It is common practice to install weights to counterbalance a loading arm about its horizontal pivot axis at the riser so that it can be more easily maneuvered. To achieve a balanced condition, some marine loading arms are provided with a support beam that is secured to the inner arm member and extends rearwardly therefrom behind the riser, and with a counterweight fixedly mounted on an inner sheave that is rotatably mounted on the support beam and connected by an endless cable to an outer sheave located at the juncture of the inner and outer arm members. The outer sheave is fixed to the outer arm member but rotatable with respect to the inner arm member, so that the counterweight, sheaves and cable balance the inner and outer arm members in all operating positions.

Although such a single-counterweighted balance system functions generally very well, one of its disadvantages is that the counterweight cannot compensate for changes in the weight of the arm members that occur as these members are filled with, or emptied of, fluid during start up and termination of the fluid transfer operation.

Another disadvantage with some of the prior art counterbalancing systems is that the outer end of the arm cannot be moved rapidly away from a marine tanker in an emergency disconnecting operation, especially if power to the arm has been disconnected or lost.

SUMMARY OF THE INVENTION

The present invention overcomes the foregoing disadvantages by providing a method and apparatus for controlling movement of a fluid loading arm upon emergency disconnection thereof from a tanker or other marine vessel. In the illustrated embodiment of the invention, the arm comprises a rigid inner member mounted on an upstanding support riser for pivotal movement about a first horizontal axis, a rigid outer member pivotally connected at one of its ends to the outer end of the inner member for pivotal movement about a second horizontal axis, a hydraulic cylinder or other power means for controlling and pivoting the inner member about the first horizontal axis, a first sheave and cable assembly extending between the inner and outer members for changing the attitude of the outer member with respect to the inner member independently of movement of said inner member, and a first or primary counterweight fixed to the inner sheave of the first sheave and cable assembly to counterbalance the inner and outer arm members in all of their operating positions.

The control system of the invention comprises a second sheave and cable assembly, a second or auxiliary counterweight, and two hydraulic cylinders or other suiable power means to control operation of the system. The first of the two sheaves of the second sheave and cable assembly is pivotally mounted on a support that is fixed to and extends rearwardly from the inner arm member, and the second sheave is mounted on the riser for pivotal movement about the first horizontal axis independently of the inner arm member. The auxiliary counterweight is secured to the first sheave and thus rotates with it. The first of the two hydraulic cylinders is mounted on the same support that carries the first sheave, and its piston is connected to the cable for controlling cable movement. The second hydraulic cylinder is mounted on the riser, and its piston is connected to the second sheave to control that sheave's movement.

Accordingly, by individually controlling the function of the two hydraulic cylinders the moment exerted by the auxiliary counterweight can be applied to the arm or the riser, the position of that counterweight with respect to a reference plane can be adjusted, and the path followed by the outer end of the arm as it moves after being disconnected from the tanker or other marine vessel can be established, thus assuring safe and fully controlled disconnection and movement of the arm under emergency conditions, even if hydraulic power to maneuver the arm has been lost.

BRIEF DESCRIPTION OF THE DRAWINGS

FIGS. 6 and 7 are schematic diagrams illustrating operation of the arm upon emergency disconnection in the two situations of FIGS. 4 and 5.

FIG. 8 is a schematic diagram showing operation of the arm during emergency disconnection, with the inner member of the arm positioned behind the riser.

FIGS. 9 and 10 illustrate additional systems for controlling movement of the arm's outer member about its pivotal connection to the inner arm member.

DESCRIPTION OF THE PREFERRED EMBODIMENT

Figure 1:
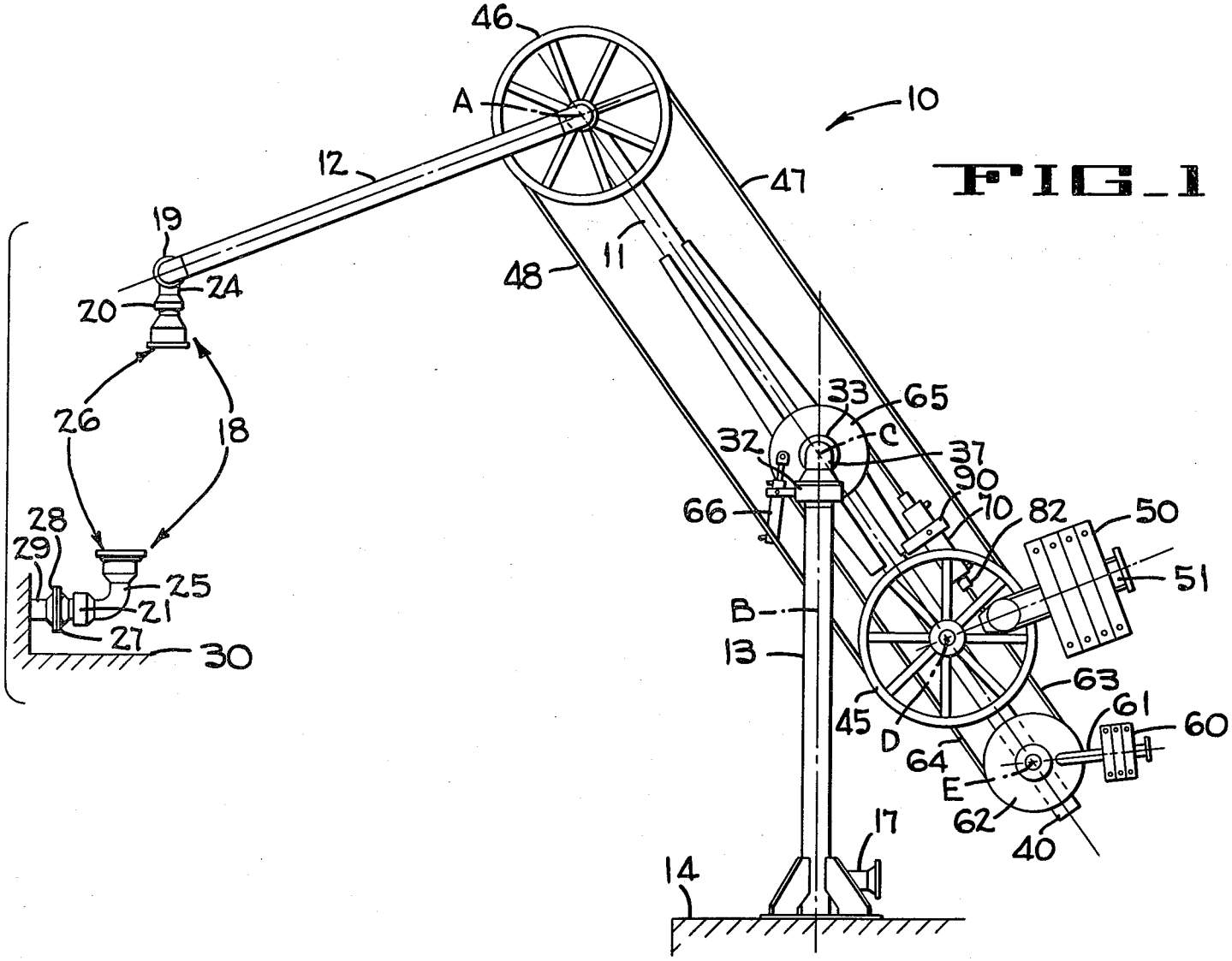
FIG. 1 is a diagrammatic side elevation of a fluid loading arm according to the present invention with the arm mounted on a dock and having undergone emergency disconnection from an adjacent marine tanker.

A fluid loading arm 10 in accordance with the present invention comprises inner and outer arm members 11 and 12, respectively, these members being pivotally interconnected in substantially end-to-end relationship for relative movement about a horizontal axis A. The inner member 11 is pivotally mounted on an upstanding riser 13 for pivotal movement about intersecting vertical and horizontal axes B and C, respectively, and the riser 13 is shown mounted on a dock or other supporting structure 14. The riser 13 is connected to a pipe line or other conduit 17 that extends to a fluid storage facility (not shown) for transferring fluid between that facility and the loading arm 10 during loading or unloading operations.

The arm's outer member 12 carries at its outer end a multiple joint assembly 18 (FIG. 1) comprising three pipe swivel joints 19, 20, and 21 oriented on mutually perpendicular axes and suitably interconnected by 90° pipe elbows 24, 25 and an emergency disconnect coupling 26 (shown disconnected). The outer end of the swivel joint assembly 18 includes a flange 27 which can be brought into alignment and connected to a flange 28 of a tanker manifold 29 to facilitate transfer of fluid from the loading arm 10 to a tanker 30. The swivel joint assembly 18 enables the loading arm to follow the movements of the marine tanker to which it is coupled so that fluid transfer can be safely and efficiently accomplished.

Figure 2:
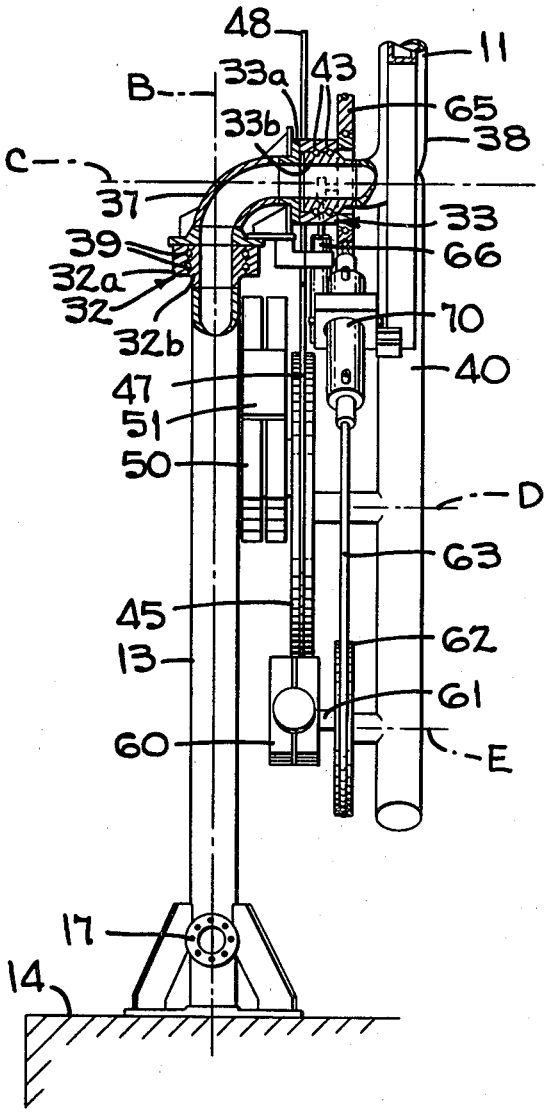
FIG. 2 is an enlarged fragmentary rear elevation of the loading arm of FIG. 1, showing details of a means for mounting the inner arm member on the support riser.

The inner arm member 11 is mounted on the riser 13 for pivotal movement about the vertical axis B and the horizontal axis C (FIG. 2) by pipe swivel joints 32, 33 respectively, and 90° pipe elbows 37, 38. The lower end of the elbow 37 is fixed to the outer or female element 32*a* of the swivel joint 32, the upper end of the riser 13 is fixed to the inner or male element 32*b* of the joint 32, and the elements 32*a*, 32*b* are rotatably interconnected by a plurality of bearing balls 39. The other or upper end of the pipe elbow 37 is fixed to the outer or female element 33*a* of the swivel joint 33, the inner end of the inner arm elbow 38 is fixed to the inner or male element 33*a* of the joint 33, and the elements 33*a*, 33*b* are rotatably interconnected by a plurality of bearing balls 43. Behind the riser 13 is a beam or other suitable support structure 40 that is welded or otherwise fixed to the elbow 38 and the inner end of the inner arm member 11, and that extends rearwardly from and generally parallel to the arm member 11.

As illustrated in FIG. 1, the loading arm 10 is counterbalanced about the horizontal axis A by a first pantograph sheave and cable assembly comprising an inboard sheave 45, an outboard sheave 46, cables 47 and 48, and a counterweight 50. The inboard sheave 45 is mounted on the support 40 for pivotal movement about a horizontal axis D, and the counterweight 50 is secured to a counterweight beam 51 that is fixed to the sheave 45 and thus pivots therewith. The outboard sheave 46 is fixed to the outer arm member 12 coaxial with the axis A, and thus pivots about that axis in unison with the outboard member 12. The cables 47 and 48 are trained around the sheaves 45, 46, and their inner ends are secured to the sheaves so that the rotation of either sheave causes like rotation of the other sheave, all in the conventional and well-known manner.

Figure 3:
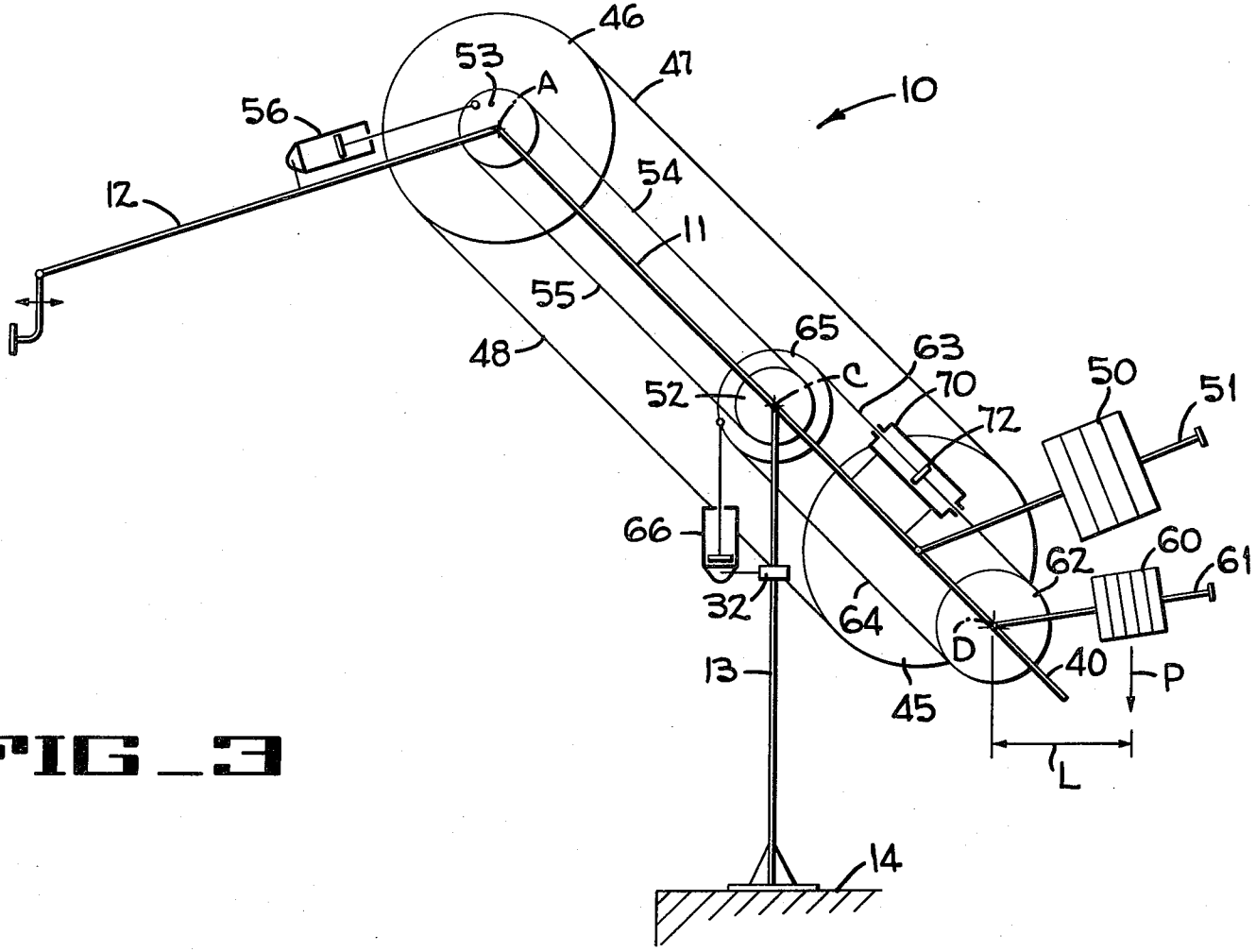
FIG. 3 is a schematic side elevation of the loading arm of FIGS. 1 and 2, but further including a system for pivoting the outer arm member relative to the inner arm member.

Pivotal movement of the outer arm member 12 about the axis A can be accomplished by various conventional means including, for example, another sheave and cable assembly (FIG. 3) comprising inner and outer sheaves 52, 53, respectively, cables 54, 55, and a hydraulic ram or cylinder assembly 56 that is functionally connected between the outer arm member 12 and the outer sheave 53. The outer sheave 53 is secured to the outer arm member 12 and is rotatable about the axis A, whereas the inner sheave 52 is fixed against rotation about the axis C. Instead of the cylinder assembly 56, two cylinder assemblies 57, 58 (FIG. 9) that are functionally connected in the cables 54, 55, or a single cylinder assembly 59 (FIG. 10) that is functionally connected between the riser 13 and the inboard sheave 45, can be employed to power the operation of this sheave and cable assembly. As is known, in the FIG. 9 system the inner sheave 52 normally is secured against rotation, whereas in the FIG. 10 system the inner sheave is rotatable about the axis C in response to operation of the cylinder assembly 59.

In accordance with the invention, in order to overcome the aforementioned disadvantages of the prior loading arms, at least one additional or auxiliary counterweight 60 is provided on the support 40 that extends rearwardly from the inner arm member 11. The auxiliary counterweight 60 is mounted on a beam 61 that is secured to a sheave 62, and this sheave is mounted on the support 40 for rotation about a horizontal axis E. The sheave 62 is connected by cables 63, 64 to another sheave 65 that is pivotally mounted on the riser 13 for rotation about the axis C, and a hydraulic ram or cylinder assembly 66 is mounted on the outer or female element 32*a* of the riser swivel 32 and functionally connected to the sheave 65 to control rotation of that sheave. Another hydraulic ram or cylinder assembly 70, with a piston 73, is secured to the support 40 and functionally connected into the cable 63 to provide a means for controlling pivotal movement of the inner arm member 11 about the horizontal axis C.

OPERATION

The operation of a loading arm in accordance with the invention is as follows.

Under normal operating conditions the loading arm is balanced with the outer arm member empty by the primary counterweight 50. In reference to FIG. 3, when the sheave 65 is hydraulically locked against rotation by means of the ram 66, the moment (PxL) generated by the auxiliary counterweight 60 and its beam 61 is transmitted to the riser 13 through the sheave 62, cable 63, sheave 65 and ram 66. Thus only the weight (P) effective at the center of the sheave 62 must be considered when balancing the arm about the axis C.

During pivotal movement of the inner arm member 11 about the horizontal axis C while the sheave 65 is locked against rotation, the auxiliary counterweight beam 61 remains in the same attitude or inclination with respect to the horizontal, that is the angle a (FIG. 4) does not change. This pivotal movement is accomplished by pressurizing one side of the piston 72 in the cylinder 70, and venting the other side, depending upon whether upward or downward movement is desired.

After the loading arm 10 has been connected to the tanker 30, the following two methods of operation are available.

Figure 4:
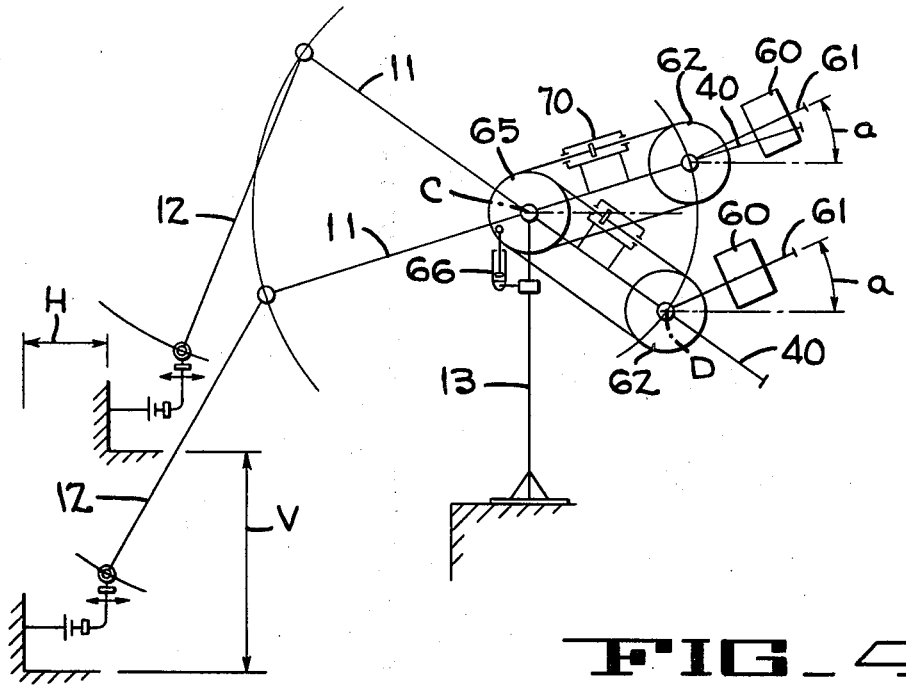
FIGS. 4 and 5 are schematic diagrams illustrating normal operation of the arm in two situations.

METHOD I (FIGS. 4 and 6)

As represented in FIG. 4, the hydraulic cylinder 66 is locked, thereby preventing rotation of the sheave 65, and the hydraulic cylinders 70 and 56 (FIG. 3) are vented so that their pistons are free to move in response to rotation of the sheave 53 and linear movement of the cable 63, respectively. In this situation the auxiliary counterweight beam 61 remains in its angular relation to the horizontal regardless of movements of the inner and/or outer arm members 11, 12 in response to movements of the tanker. In other words, angle a (FIG. 4) remains unchanged.

As represented in FIG. 6, at the onset of emergency disconnection the cylinder 70 is locked and the cylinder 66 is vented, thereby releasing sheave 65 and transmitting the moment (PxL) of the auxiliary counterweight 60 and its beam 61 from the riser 13 to the support 40 and thus the inner arm member 11. The cylinder 56 (FIG. 3) can be locked or vented, depending upon its location, so that the attitude of the outer arm member 12 with respect to the horizontal, or in other words the angle dI, remains constant. The inner arm member 11 pivots clockwise, that is in the direction of the arrow FI (FIG. 6), about the horizontal axis C until the piston of the cylinder assembly 66 comes to rest against the upper end of the cylinder. As will be understood, the stroke SI (FIG. 6) of the cylinder 66 governs the angle e through which the inner arm member 11 can pivot.

The result of this method of operation is that the outer end of the loading arm 10 follows a safe path P1 (FIG. 6), as distinguished from an unsafe path P2 that would be followed absent the present invention, that avoids collision with the tanker, regardless of the horizontal H and/or vertical V changes in the position of the tanker's manifold between the time the arm is connected thereto and when emergency disconnection occurs.

Figure 5:
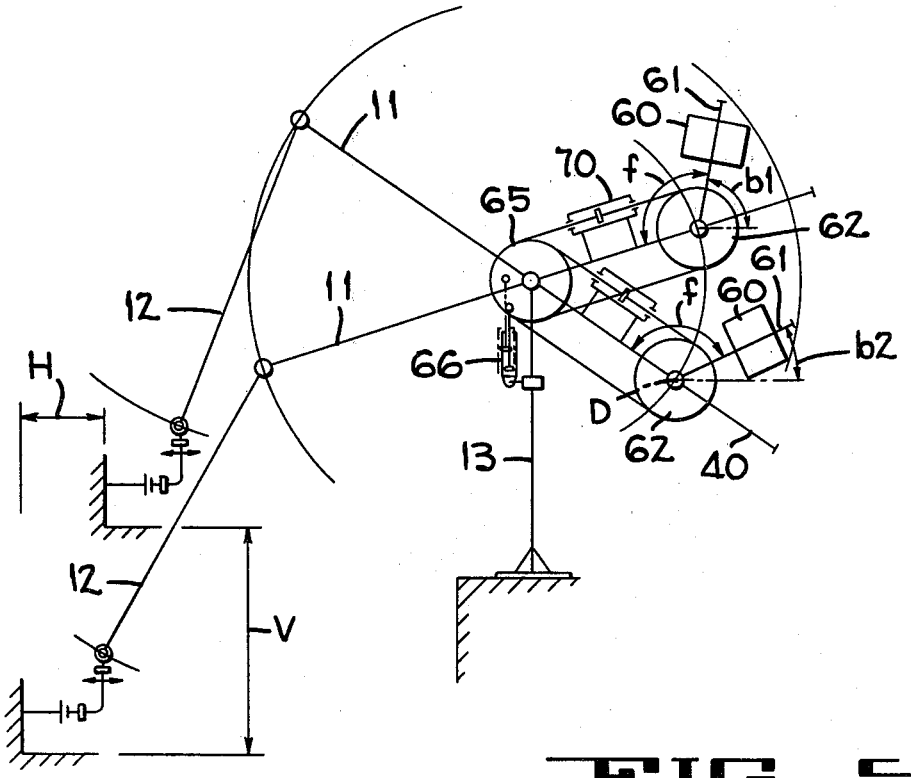

METHOD II (FIGS. 5 and 7)

As represented in FIG. 5, the cylinders 66 and 56 (FIG 3) are vented, thereby freeing the sheave 65 for rotation about the axis C and the outer arm member 12 for pivotal movement about the axis A, and the cylinder 70 is locked, thereby transmitting the moment (PxL) of the auxiliary counterweight 60 and its beam 61 to the inner arm member 11. In this situation the inner arm member 11 is free to pivot about the axis C, and the arm is either under-balanced or over-balanced depending upon the position of the inner arm member 11 at the time of connection to the tanker. Furthermore, the auxiliary counterweight beam 61 remains in its angular relationship f (FIG. 5) with the support 40, and thus the inner arm member 11, as the tanker moves vertically V and horizontally H while the arm is connected thereto, whereas the attitude of the beam 61 with respect to the horizontal changes, as represented by g1 and g2 in FIG. 5.

As represented in FIG. 7, at the onset of emergency disconnection, and since the arm 10 is either over- or under-balanced, the inner arm member 11 pivots clockwise in the direction of the arrow FII. Furthermore, by locking the cylinder 56 (FIG. 3) the attitude of angle dII of the outer arm member 12 with respect to the horizontal remains unchanged.

The result of this method of operation is that the outer end of the loading arm 10 follows a safe path P3 (FIG. 7), as contrasted with the unsafe path P4 that would be followed in the absence of this invention, that prevents the arm from striking the tanker regardless of the position of the tanker's manifold at the time of emergency disconnection.

As illustrated in FIG. 8, even if the inner arm member 11 is in an attitude wherein the axis A is behind the riser's vertical axis B when emergency disconnection occurs, the arm member 11 will pivot clockwise about the riser's horizontal axis C, that is in the direction of the arrow F2, thereby preventing the arm's outer end from striking the tanker.

Although the best mode contemplated for carrying out the present invention has been herein shown and described, it will be apparent that modification and variation may be made without departing from what is regarded to be the subject matter of the invention.

What is claimed is:

1. An articulated loading arm for transferring fluid from one fluid handling means to another and for quickly moving the outer end of the loading arm away from an adjacent handling means during an emergency disconnection, said arm comprising:

an inner arm member;

means mounting said inner arm member for pivotal movement about a first horizontal axis;

an outer arm member pivotally connected at one of its ends to the outer end of said inner arm member for movement about a second horizontal axis;

a primary counterweight pivotally mounted on a support fixed to and extending rearwardly from said inner arm member, said primary counterweight coupled to said outer arm member to counterbalance said loading arm about said first horizontal axis and said outer arm member about said second horizontal axis;

an auxiliary counterweight pivotally mounted on said support to confine elevational movement of the outer end of said loading arm in a safe path upon emergency disconnection thereof from said adjacent fluid handling means;

means for transferring the moment generated by said auxiliary counterweight from said support to said mounting means; and control means cooperating with said transferring means and said mounting means for controlling pivotal movement of said auxiliary counterweight with respect to said support.

2. An articulated loading arm for transferring fluid from one fluid handling means to another and for quickly moving a disconnected outboard end of the loading arm away from an adjacent handling means during an emergency disconnection, said arm comprising:

a rigid inner arm member;

means mounting said inner arm member for pivotal movement about a first horizontal axis;

a rigid outer arm member pivotally connected at one of its ends to the outer end of said inner arm member for movement about a second horizontal axis;

support means connected to the inner end of said inner arm member and extending rearward therefrom;

a primary counterweight pivotally mounted on said support means and coupled to said outer arm member to counterbalance said loading arm about said first horizontal axis;

a first sheave pivotally mounted about said first horizontal axis;

a second sheave pivotally mounted on said support means;

control means connected to said mounting means and said first sheave for controlling rotation of said first sheave about said first horizontal axis;

means for coupling said first sheave to said second sheave; and an auxiliary counterweight connected to and rotatable with said second sheave to adjust the balance state of said loading arm about said first horizontal axis.

3. An articulated loading arm as defined in claim 2 including means for rotating said second sheave to change the moment of said auxiliary counterweight.

4. An articulated loading arm as defined in claim 2 wherein the control means comprises a hydraulic ram.

5. An articulated loading arm as defined in claim 2 wherein the coupling means comprises a cable assembly.

6. An articulated loading arm as defined in claim 5 wherein the coupling means further includes a hydraulic ram functionally connected to the cable assembly.

7. An articulated loading arm as defined in claim 2 including means for pivoting the outer arm member with respect to the inner arm member.

* * * * *